US009149901B2

(12) United States Patent
Shiroishi et al.

(10) Patent No.: US 9,149,901 B2
(45) Date of Patent: Oct. 6, 2015

(54) METHOD OF POLISHING THE DIAMOND-SURFACE

(75) Inventors: Ryozo Shiroishi, Kanagawa (JP); Kenichi Takao, Kanagawa (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 162 days.

(21) Appl. No.: 13/991,294

(22) PCT Filed: Jul. 26, 2011

(86) PCT No.: PCT/JP2011/066952
§ 371 (c)(1),
(2), (4) Date: Jun. 3, 2013

(87) PCT Pub. No.: WO2012/090540
PCT Pub. Date: Jul. 5, 2012

(65) Prior Publication Data

US 2013/0252515 A1 Sep. 26, 2013

(30) Foreign Application Priority Data

Dec. 28, 2010 (JP) ..... 2010-292145

(51) Int. Cl.
*B24B 1/00* (2006.01)
*B24B 9/16* (2006.01)

(52) U.S. Cl.
CPC .... *B24B 1/00* (2013.01); *B24B 9/16* (2013.01)

(58) Field of Classification Search
USPC ..... 451/41, 56, 258, 287, 289
See application file for complete search history.

(56) References Cited

U.S. PATENT DOCUMENTS

| | | | | |
|---|---|---|---|---|
| 5,725,413 | A * | 3/1998 | Malshe et al. | 451/41 |
| 5,955,212 | A * | 9/1999 | Matsumoto et al. | 428/698 |
| 6,361,411 | B1 * | 3/2002 | Chopra et al. | 451/56 |
| 6,585,565 | B2 | 7/2003 | Abe et al. | |
| 6,592,436 | B1 | 7/2003 | Abe et al. | |
| 6,655,845 | B1 * | 12/2003 | Pope et al. | 384/492 |

(Continued)

FOREIGN PATENT DOCUMENTS

| | | |
|---|---|---|
| JP | 44-2958 | 2/1969 |
| JP | 58-82661 | 5/1983 |

(Continued)

OTHER PUBLICATIONS

International Search Report issued Sep. 13, 2011 in PCT/JP2011/066952.

(Continued)

*Primary Examiner* — Lee D Wilson
*Assistant Examiner* — Shantese McDonald
(74) *Attorney, Agent, or Firm* — Greenblum & Bernstein, P.L.C.

(57) ABSTRACT

A method of polishing the diamond-surfaces generates abraded powder less, enables the polishing member to maintain an extended life and to be easily controlled, makes it possible to obtain the surfaces of a high degree of smoothness, and can be easily applied to polishing rugged three-dimensional surfaces, too. A method of polishing the diamond-surface by using a polishing member that has a metal-surface that easily reacts with carbon or of a carburizing metal, irradiating the diamond-surface with a laser beam prior to polishing the diamond-surface with the polishing member, following the irradiation with the laser beam, the polishing is conducted by rubbing a laser beam-irradiated portion with the polishing member.

20 Claims, 6 Drawing Sheets

(56) References Cited

U.S. PATENT DOCUMENTS

| | | | |
|---|---|---|---|
| 2003/0091826 | A1 | 5/2003 | Abe et al. |
| 2010/0311313 | A1 | 12/2010 | Uchiyama |

FOREIGN PATENT DOCUMENTS

| | | |
|---|---|---|
| JP | 6-170571 | 6/1994 |
| JP | 7-75818 | 8/1995 |
| JP | 7-314299 | 12/1995 |
| JP | 09-117852 | 5/1997 |
| JP | 2001-198833 | 7/2001 |
| JP | 2005-231022 | 9/2005 |
| KR | 10-2010-0084542 | 7/2010 |

OTHER PUBLICATIONS

Korea Office action in KR 10-2013-7017272, mail date is Sep. 30, 2014.
Japan Office action, mail date is Dec. 2, 2014.

* cited by examiner

METHOD OF POLISHING THE DIAMOND-SURFACE

TECHNICAL FIELD

This invention relates to a method of polishing the diamond-surface and, more specifically, to a method of polishing the various kinds of diamond product-surface.

BACKGROUND ART

As is well known, the diamond which is a crystal of carbon has been used for a variety of applications owing to its very high hardness, excellent resistance against abrasion as well as excellent slipping property, heat conductivity and high refractive index. For instance, it has been used for the tools for cutting, such as cutting tool, end mill and file, metal molds for plastic machining, such as punch and dies, sliding members such as valve lifter and bearing, heat-radiating members such as heat sink, electronic circuit boards and optical parts such as lens and window.

In order for their properties to be exhibited to a sufficient degree, these diamond products must have the diamond-surface polished to assume smooth surface.

The diamond-surface had so far been mechanically polished by using grains or a grind stone of diamond requiring extended periods of time. Besides, since both of them are abraded, there occurred such problems as short life of the tool and not being suited for polishing rugged three-dimensional surfaces. In an effort to improving the above defects, therefore, various kinds of polishing methods have now been proposed.

A patent document 1, for example, proposes a polishing method which conducts the polishing by using a polishing member constituted by a metal that easily reacts with carbon in the diamond crystals, applying ultrasonic waves onto the polishing member, and pushing the polishing member onto the surfaces of the diamond while the polishing member is undergoing ultrasonic oscillation. Here, examples of the metal that easily reacts with carbon include a γ-Fe-containing stainless steel, titanium (Ti), zirconium (Zr) and tantalum (Ta).

A patent document 2 proposes a polishing method by using, as a grind stone, an intermetallic compound of at least one metal element selected from the group consisting of Al, Cr, Mn, Fe, Co and Ni and at least one metal element selected from the group consisting of Zr, Hf, V, Nb, MO, Ta and W, and pushing the grind stone onto the diamond-surface that is moving relative thereto while, as required, heating the grind stone at 100 to 800° C.

A patent document 3 proposes a method of polishing the diamond-surface by focusing the laser beam on the diamond-surface.

A patent document 4 proposes a method of polishing a diamond film by sliding a metal and the diamond relative to each other at a point where the two are contacting to each other while continuously varying the temperature over a range of 700° C. to 1000° C. at the portion where the metal and the diamond are contacting to each other.

PRIOR ART DOCUMENTS

Patent Documents

Patent document 1: JP-A-2005-231022
Patent document 2: JP-A-2001-198833
Patent document 3: JP-A-6-170571
Patent document 4: JP-A-7-314299

OUTLINE OF THE INVENTION

Problems that the Invention is to Solve

The methods proposed by the above prior arts, however, still leave problems that must be solved, and improvements have been desired.

For example, the method proposed by the patent document 1 executes the polishing by causing the metal constituting the polishing member to undergo chemical reaction with carbon on the diamond-surface by utilizing the heat of friction produced by ultrasonic oscillation. Upon utilizing the heat of friction produced by ultrasonic oscillation, however, the temperature must be controlled relying on the frequency and the pushing force involving great difficulty, and it is not easy to conduct the polishing maintaining stability and constant efficiency.

Upon utilizing the heat of friction, further, the energy efficiency is low and to elevate the temperature, the polishing member must be pushed onto the diamond-surface with a considerable pushing force. Besides, the hardness of the metal constituting the polishing member is very lower than that of the diamond. Accordingly, the polishing member abrades conspicuously and has only a short life.

Besides, since the polishing member must be pushed onto the diamond-surface with a considerable pushing force, the polishing machine and, specifically, the surrounding of the polishing member must have an increased toughness resulting in an increase in the size of the apparatus.

According to the method proposed in the patent document 2, the polishing is carried out by using a grind stone that contains as grains a very hard intermetallic compound. However, use of the special intermetallic compound drives up the cost strikingly. Further, since the polishing is conducted by pushing the hard intermetallic compound (hardness Hv of 500 to 1000) onto the diamond-surface, abraded powder generates much due to the abrasion of grains. Besides, the surfaces of the powder are highly and chemically active and, therefore, the abraded powder that is generated much may cause ignition and explosion. Moreover, the mechanical polishing by pushing the grind stone onto the diamond-surface needs the apparatus that tends to become bulky.

According to the method proposed in the patent document 3, the polishing is conducted by gasifying carbon in the diamond-surface by being heated by using a laser beam. However, the laser beam must be emitted so as to be focused on a convex portion on the diamond-surface, and it is very difficult to control the emission of the laser beam. Therefore, there remains a problem in that a very extended period of time is required for polishing a material having an area that is wide to some extent (e.g., several tens of square centimeters or more).

According to the method proposed in the patent document 4, the polishing is conducted by sliding the metal and the diamond relative to each other at a portion where they are contacting to each other while continuously varying the temperature over a range of 700° C. to 1000° C. at the portion where they are contacting to each other. According to this method, heating is conducted by a heater and the temperature cannot be instantaneously varied imposing limitation on adjusting the amount of polishing. According to the patent document 4, further, the polishing member is formed in a spherical shape to prevent deviated abrasion, and is rotated at a low speed. When the axis of rotation is fixed, however, the same contacting state can be maintained for only one turn. When it is attempted to utilize a wider surface, therefore, the axis of rotation must be freely varied causing the apparatus to become complex.

It is, therefore, an object of the present invention to provide a method of polishing the diamond-surface which generates abraded powder less, enables the polishing member to maintain an extended life and to be easily controlled, makes it possible to obtain the surface of a high degree of smoothness, and can be easily applied to polishing rugged three-dimensional surface, too.

Another object of the present invention is to provide a method of polishing the diamond-surface that is capable of conducting the polishing without using an expensive material obtained by a special production method, such as intermetallic compound but using a polishing member formed by using an inexpensive simple metal.

Means for Solving the Problems

According to the present invention, there is provided a method of polishing a diamond-surface by:

using a polishing member that has a linear, belt-like or rod-like shape and has a metal-surface that easily reacts with carbon or has a carburizing metal-surface;

polishing the diamond-surface with said polishing member while continuously or intermittently varying a polishing surface of said polishing member; and heating said polishing member and/or said the diamond-surface prior to polishing with said polishing member.

In the present invention, the metal that easily reacts with carbon is a metal having a temperature region in which a change in the Gibb's free energy (ΔG) in the carbide-forming reaction assumes a negative sign and, particularly preferably, is a metal of which the amount of change in the free energy (ΔG) in the carbide-forming reaction is not more than −20 kcal/mol in a temperature region that does not exceed the temperature (750 to 850° C.) at which the diamond carbonizes. Amounts of change in the Gibb's free energy of various metals in the carbide-forming reaction have been known as described, for example, in the Metals Data Book, $4^{th}$ Edition (Edited by The Japan Institute of Metals, Maruzen Co.).

Further, the carburizing metal is a metal into which carbon can be diffused and permeated from the surface thereof.

In the polishing method of the present invention, it is desired that:

(1) The diamond-surface is heated by a irradiation with a laser beam (laser beam-irradiation) prior to polishing with said polishing member, and following the laser beam-irradiation, said polishing is conducted by rubbing a laser beam-irradiated portion with the polishing member;

(2) The polishing member is the one having the metal-surface that easily reacts with carbon, the metal being Zr, Ta, Ti, W, Nb or Al;

(3) The polishing member is the one having the carburizing metal-surface, the carburizing metal being Fe, Ni or Co; and (4) The diamond-surface is heated and the polishing member is heated prior to polishing with said polishing member.

Effects of the Invention

In the present invention, the polishing is conducted by rubbing the diamond-surface with the polishing member-surface. Here, the polishing member-surface is formed of a metal that easily reacts with carbon or of a carburizing metal, and the polishing member or the diamond-surface is heated prior to polishing with the polishing member. In the polishing, therefore, carbon on the diamond-surface reacts with the easily reacting metal that is forming the polishing member-surface, or diffuses and permeates in the layer of the carburizing metal-surface. As a result, the diamond-surface is robbed of carbon and is effectively polished.

In the invention, further, the polishing member that is used has a linear, belt-like or rod-like shape, and the polishing is conducted while continuously or intermittently varying the polishing member-surface formed of the above-mentioned metal material. That is, since the diamond-surface is slide-rubbed while varying the contacting portion, the reaction (reaction of the easily reacting metal with carbon on the diamond-surface, or diffusion and permeation of carbon) does not reach the saturated state, the surface pressure is not changed by abrasion, and the process continues maintaining stability at all times. Accordingly, the polishing can be continued maintaining stability for extended periods of time.

In the present invention, it is desired to use Zr, Ta, Ti or Al as the metal that forms the polishing member-surface and easily reacts with carbon. These metals are all soft metals and have Vickers' hardnesses (Hv) which are all not higher than 200 and are not only very lower than that of the diamond-surface but also considerably lower than the hardness of 500 to 1000 of the grind stone of an intermetallic compound used in the above patent document 2. Since the diamond-surface is slide-rubbed by the metal of such a low hardness so as to be polished, generation of the abraded powder can be effectively suppressed as compared to when a highly hard metal or metal compound is used making it possible to lengthen the life of the polishing member, which is a great advantage of the present invention.

Further, it is desired to use Fe, Ni or Co as the carburizing metal that forms the polishing member-surface. These metals have a property that permits carbon to diffuse and permeate therein from the surface thereof.

In the invention, further it is desired that the diamond-surface is heated by the laser beam-irradiation prior to polishing and to polish the laser beam-irradiated portion by using the polishing member. Namely, laser beam-irradiation is simply for heating at such a temperature at which the metal of the polishing member-surface reacts with carbon or at such a temperature at which the polishing member-surface is carburized with carbon on the diamond-surface. It should be noted that the laser beam-irradiation is not for vaporizing or volatilizing the carbon on the diamond-surface. Therefore, there is no need of adjusting the polishing conditions in a complex manner, and it is allowed to fabricate the apparatus in a compact size, to effectively apply the polishing method even to polishing rugged and three-dimensional surface and curved surface enabling the diamond-surface to be effectively smoothed.

Further, in heating the diamond-surface by the laser beam-irradiation, the diamond-surface is locally heated, i.e., a spot on the surface is heated instantaneously. Therefore, in polishing a diamond film formed on a predetermined substrate, the diamond film is not damaged by a difference in the thermal expansion between the diamond film and the substrate. Besides, since the heating is locally conducted, the energy can be utilized very highly efficiently.

Moreover, the intensity of the laser beam can be varied instantaneously making it possible to adjust the amount of polishing by varying the temperature of heating. Concretely, the surface property is monitored and the data are fed back to improve the evenness of the surface or to form fine ruggedness on the surface.

In the present invention, it is desired to heat both the polishing member and the diamond-surface prior to polishing the diamond-surface with the polishing member. In polishing the diamond-surface, the heating further accelerates the reaction of carbon on the diamond-surface with the metal forming the polishing member-surface or further accelerates carburization of the metal surface contributing to conducting the polishing efficiently and in a short period of time.

According to the present invention, further, the polishing member is formed using an existing simple metal instead of using a special compound such as intermetallic compound offering advantage from the standpoint of cost, too.

MODES FOR CARRYING OUT THE INVENTION

Figure 1:
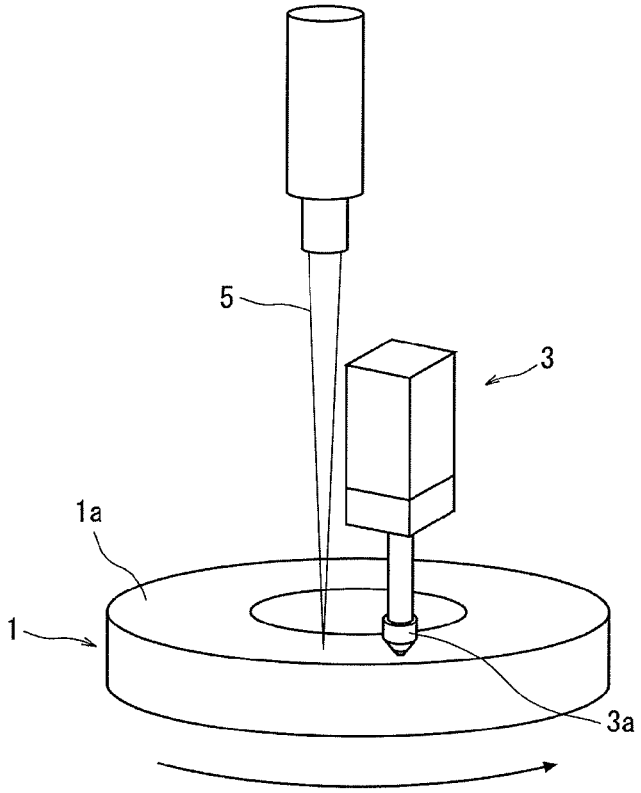
FIG. 1 is a schematic view illustrating a method of polishing according to the present invention.

Referring to FIG. 1, the present invention is to polish a workpiece 1 that has a diamond-surface 1*a*. Here, the workpiece 1 may have any shape suited for the use so far as it has the diamond-surface 1*a* of a single crystal, polycrystals or a thin film.

The diamond-surface 1*a* of the workpiece 1 is polished by using a polishing device 3 equipped with a polishing member 3*a* that rubs the diamond-surface 1*a* sliding on it. In the embodiment of the invention shown in FIG. 1, the surface 1*a* is irradiated with a laser beam 5 prior to polishing and after having been irradiated, the portion irradiated with the laser beam 5 is polished by the polishing device 3.

The polishing device 3 is equipped with the polishing member 3*a* that rubs the diamond-surface 1*a* sliding on it, the polishing member 3*a* being formed of a metal that easily reacts with carbon or of a carburizing metal.

As described above, the metal that easily reacts with carbon is a metal having a temperature region in which a change in the Gibb's free energy (ΔG) in the carbide-forming reaction assumes a negative sign, and its examples include Zr, Ta, Ti, W, Nb and Al. Among them, Zr, Ta, Ti, and Al are preferred. As described above, these metals have surface hardnesses Hv (Vickers' hardnesses) which are very low; e.g., Ta being about 100 to 150, Zr being about 120 to 200, Ti being about 100 to 200, and Al being about 15 to 50. Therefore, upon conducting the polishing by using such soft metals, it is allowed to effectively suppress the abrasion or deformation even when the polishing is conducted with a slide-rubbing force based on the above small pushing force making it possible not only to effectively prevent the abraded powder from being generated in large amounts but also to lengthen the life of the polishing member 3*a* and to conduct the polishing maintaining stability and good precision for extended periods of time.

Among the above soft metals, Zr, Ta and Ti are most desired. These metals have amounts of change in the Gibb's free energy (ΔG) in the reaction for forming carbide (ZrC, TaC, TiC) of not more than −20 kcal/mol and, specifically, as small as about −30 to −45 kcal/mol in a temperature region that does not exceed the temperature (750 to 850° C.) at which the diamond carbonizes. Due to the slide-rubbing after heated by the irradiation with the laser beam 5, therefore, the metal very easily reacts with carbon on the diamond-surface 1*a* and effectively polishes the diamond-surface 1*a*. For example, as demonstrated by the experimental results (see FIG. 5) of an Experiment appearing later, a rough surface of a roughness Rz (maximum height) of about 1.5 μm can be polished into a smooth surface of a roughness of about 0.8 μm in a short period of time.

As the carburizing metal, there can be exemplified Fe, Ni and Co. Among them, it is desired to use Ni for forming the surface of the polishing member 3*a*. Namely, when the polishing member 3*a* having the carburizing metal-surface is used, carbon atoms on the diamond-surface 1*a* diffuse in the surface of the polishing member 3*a* at the time of polishing with the polishing member 3*a*, and the diamond-surface can be effectively polished.

Polishing with the polishing member 3*a* is conducted by rubbing the portion irradiated with the laser beam by using the polishing member 3*a* that slides thereon; i.e., no large pushing force is necessary for the slide-rubbing. Though an appropriate pushing force may differ depending on the shape and material of the polishing member, it has been confirmed that the polishing can be conducted with a pushing force of about 5 N (0.5 kgf). On the other hand, the true contact area increases with an increase in the pushing force, and the polishing tends to accelerate. Therefore, the pushing force may be suitably set depending on the shape of the workpiece, shape and material of the polishing member corresponding thereto, and rigidity of the apparatus. In any way, the present invention does not require such a pushing force that causes an end of the polishing member to be greatly deformed. Therefore, the polishing member and the holding fitting can be realized in small sizes offering advantage from the standpoint of polishing the workpieces that have complex shapes and holes of small diameters therein.

Figure 4:
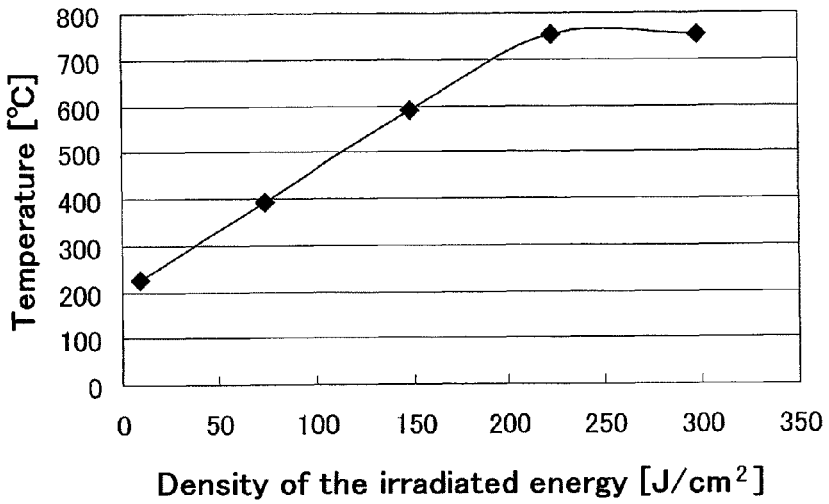
FIG. 4 is a diagram showing a relationship between the density of the irradiated energy and the temperature.

In the invention, the diamond-surface 1*a* is locally heated by being irradiated with the laser beam 5 so that the metal forming the surface of the polishing member 3*a* easily reacts with carbon, and the degree of heating is determined by the density of the laser irradiation energy and the energy absorbency of the diamond. Concretely, the laser output, width of irradiation (spot diameter) and rate of working are suitably set based on the energy absorbency of the diamond to the laser source used for the polishing. FIG. 4 shows a relationship between the density of the energy of when a 10 μm-thick diamond coated on a super hard alloy is irradiated with a carbon dioxide gas laser and the temperature on the diamond-surface though it may really differ depending on the shape, thickness and the laser species.

The temperature was measured by using a radiation thermometer (FTK9-R220A-2.5B11) manufactured by Japan Sensor Co.

According to the above relationship, the temperature increases with an increase in the density of the irradiated energy. If the density of the irradiated energy increases too much, the diamond is carbonized at around 750 to 850° C., and the temperature does not rise any more.

According to the present invention, therefore, the radiation conditions such as the density of the laser beam irradiation energy must be so set that the diamond-surface 1*a* is heated to a temperature range that does not exceed the temperature (750 to 850° C.) at which the diamond carbonizes. When a metal that easily reacts is used for the polishing member 3*a*, the temperature range is not lower than 200° C. and, specifically, is from 220° C. to 800° C. and when a carburizing metal is used, the temperature range is not lower than 600° C. and, specifically, is from 700° C. to 800° C. The irradiation condition may then be so set that the diamond-surface is heated at a temperature within the above range but does not exceed the melting point of the metal used for the polishing member 3*a*.

A variety of kinds of laser sources have been known for emitting the laser beam 5. In the present invention, the level of heating is so low that the laser source is not limited, and any known laser can be used. To conduct the polishing maintaining stability and, for example, in the field of welding and machining, solid lasers have been widely used, such as YAG and fiber laser. According to the present invention, however, it is also allowable to use gas lasers such as carbon dioxide gas laser and excimer laser in addition to the solid lasers.

Though there is no special limitation on the width of irradiation (spot diameter) of the laser beam 5, it is desired that it is close to the width over which the polishing member 3*a* comes in contact with the diamond from the standpoint of energy efficiency of the laser beam and the efficiency of polishing. For example, if the width of irradiation is very smaller than the width of contact between the two, the polishing does not proceed on the portions where the temperature is low (portions that are not irradiated) and, as a result, an extended period of time is required for the polishing. If the width of irradiation is set to be too wide, on the other hand, then the portions that need not be heated (that are not polished) are heated resulting in a loss of energy and making it necessary to undesirably increase the output of the laser beam or to decrease the rate of machining. The width in which the polishing member 3*a* comes in contact with the diamond can be roughly calculated in compliance with the widely known Hertz's law.

In the present invention, a portion is irradiated with the laser beam 5 and, thereafter, the irradiated portion is polished with the polishing member 3*a*. Here, the timing of polishing is that the surface of the irradiated portion is still maintained at about a temperature at which the metal of the polishing member 3*a* undergoes the reaction (or carburization) with carbon on the diamond-surface 1*a*. Here, however, since the diamond has a very high thermal conductivity (tends to be quickly cooled), it is desired to bring the irradiated portion as close to the polishing member 3*a* as possible so far as it is permitted by the installation space to shorten the time.

In the present invention, it is also allowable to heat the diamond-surface 1*a* by a known heating means such as various kinds of heaters, hot air, heating by flowing an electric current through a resistor, induction heating or high-energy beam instead of irradiation with the laser beam under a condition that the diamond is not carbonized. As described above, however, it is most desired to heat the diamond-surface 1*a* by the laser beam-irradiation.

In the invention as shown in FIG. 1, a unit for irradiating the laser beam 5 and the polishing member 3*a* of the polishing device 3 are arranged in concentric, and the diamond-surface is polished by being rubbed with the polishing member 3*a* that slides on it while being irradiated with the laser beam 5 in a state where the workpiece 1 is being rotated. Further, the polishing device 3 (polishing member 3*a*) and the source of irradiating the laser beam 5 are caused to move intermittently or continuously in the radial direction of the workpiece 1 to polish the whole diamond-surface 1*a*.

It is also allowable to polish the portion irradiated with the laser beam 5 by rotating the polishing device 3 (polishing member 3*a*) and the source of irradiating the laser beam 5 instead of rotating the workpiece 1. It is, however, a generally accepted practice to rotate the workpiece 1 since it does not cause the apparatus to become bulky. If the polishing cannot be accomplished to a sufficient degree by the polishing of one time only, then the above-mentioned operation may be repeated a plurality of times to further continue the polishing.

Figure 2:
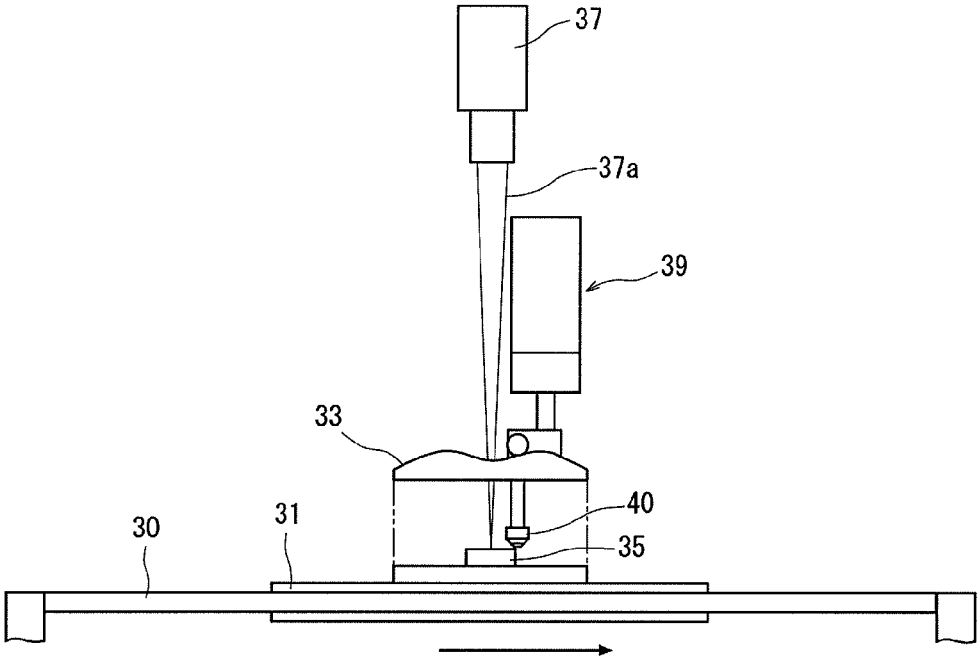
FIG. 2 is a schematic view illustrating a method of polishing according to the present invention.

Depending on the shape of the surface of the workpiece 1, further, the workpiece 1 or the polishing device 3 (polishing member 3*a*) and the source of irradiating the laser beam 5 may be caused to linearly slide to conduct the polishing. Referring, for example, to FIG. 2, a workpiece 35 is fixed on a table 31 that can slide on a rail 30, a laser source 37 is arranged over the table 31, and a polishing device 39 is provided in parallel with the laser source 37. The polishing device 39 has a polishing member 40 attached to the lower end thereof. The diamond-surface of the workpiece 35 is polished by being rubbed with the polishing member 40 that slides on it while being irradiated with a laser beam 37*a* as the table 31 moves a round trip. It is also allowable to place the workpiece 35 on a support member 33 and to fix the support member 33 onto the table 31.

In order to efficiently conduct the polishing by causing the carbon atoms on the diamond-surface to react with the metal on the polishing surface of the polishing member or by causing the carbon atoms on the diamond-surface to diffuse and permeate into the polishing member-surface in the present invention, it is important that the polishing member 3*a* has a linear shape (wire shape), belt-like shape or rod-like shape and, further, that the contacting portion of the polishing member is varied continuously or intermittently while conducting the polishing. That is, the polishing member-surface (contacting portion) that is in contact with the diamond-surface varies at all times, enabling the carbon atoms to react with the metal or enabling the carbon atoms to diffuse and permeate efficiently at all times and permitting the polishing to be stably conducted at all times without any change in the surface pressure that is caused by the abrasion. As a result, the polishing can be conducted maintaining stability over extended periods of time.

Figure 3:
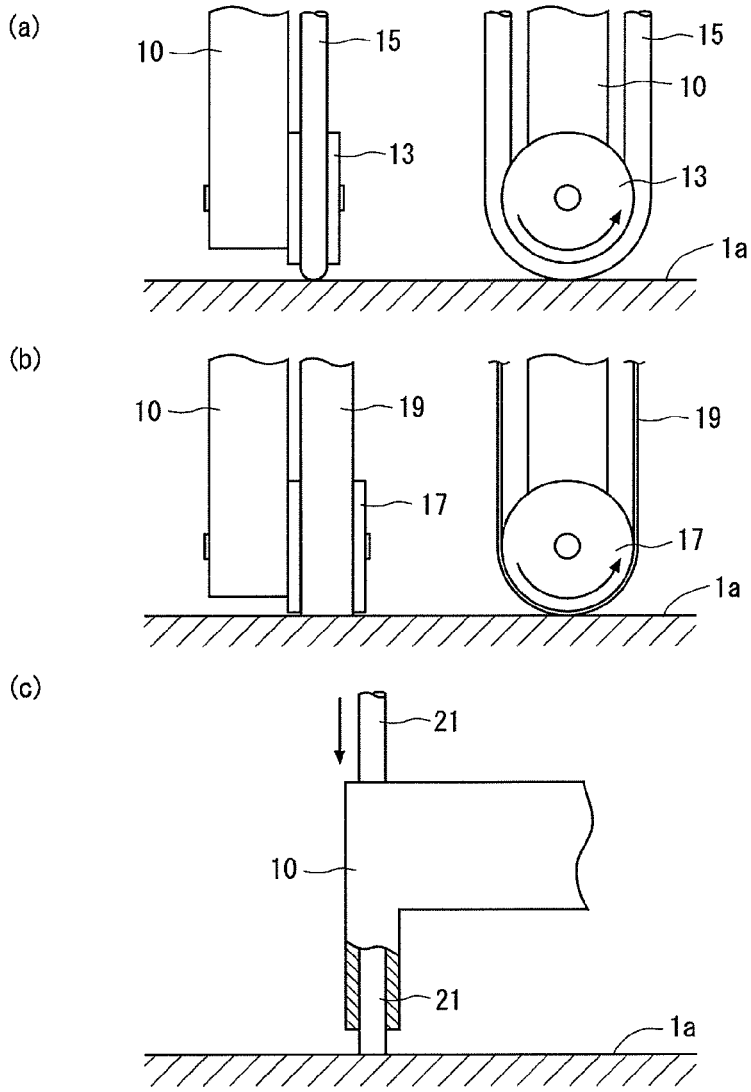
FIGS. 3(*a*), 3(*b*), and 3(*c*) are views showing the forms of polishing members used for conducting the methods of polishing of FIGS. 1 and 2.

FIG. 3 shows examples of the polishing members 3*a* of various shapes used in the invention.

Referring, for example, to FIG. 3(*a*), an endless wire 15 is wound round a pulley 13 that is held by a predetermined support member 10. The wire 15 serves as the polishing member 3*a* that is made from a metal that easily reacts with carbon (or is made from a carburizing metal).

Referring to FIG. 3(*b*), an endless belt 19 is wound round a roller 17 held by the support member 10 and serves as the polishing member 3*a*.

Referring to FIG. 3(*c*), a rod 21 is penetrating through the sleeve-like support member 10 and its lower end surface rubs the diamond-surface 1*a* sliding thereon. That is, the rod 21 serves as the polishing member 3*a*.

Upon driving the pulley 13 or the roller 17, the endless wire 15 or the endless belt 19 polishes the diamond-surface 1*a* while continuously or intermittently varying its rubbing surface. Further, the rod 21 is continuously or intermittently delivered so as to conduct the polishing.

Upon conducting the polishing by continuously or intermittently driving the polishing member 3*a* or, preferably, by continuously driving the polishing member 3*a*, the surface thereof that contacts to the diamond is not worn out through the polishing and is not abraded. Therefore, the surface pressure does not change, and the polishing can be continued maintaining stability over extended periods of time.

Further, when the polishing member 3*a* has a spherical shape as described in, for example, the patent document 4, the same effect can be expected by rotating the sphere. If the axis of rotation is fixed, however, the polishing member can be used for only one turn. To make the axis of rotation free, however, the apparatus becomes complex.

In the present invention, it is most desired to employ, specifically, the linear shape (endless wire 15) as shown in FIG. 3(*a*) and the belt-like shape (endless belt 19) as shown in FIG. 3(*b*). Namely, in these cases, the slide-rubbing surface of the polishing member 3*a* comes into point contact or line contact with the diamond-surface 1*a* to maintain a high polishing efficiency as well as to conduct the polishing with a new surface at all times. Therefore, the surface pressure is not changed by the abrasion, and the polishing can be continued maintaining stability over extended periods of time.

In the present invention, further, the polishing member 3*a* is heated in advance to attain a synergistic effect. This makes it possible to further elevate the temperature on the diamond-surface and to accelerate the reaction of carbon in the diamond-surface 1*a* with the metal on the surface of the polishing member 3*a* or to accelerate the carburization of the metal surface (diffusion of carbon). As a result, the output of the laser beam can be maintained low.

When the polishing is conducted by heating the polishing member 3*a*, the diamond-surface can be polished maintaining a certain degree of efficiency relying only on the slide-rubbing with the polishing member 3*a* without being irradiated with the laser beam.

The above heating is effected such that the diamond-surface 1*a* or the surface of the polishing member 3*a* or the two are heated at a temperature of not lower than 200° C. and, specifically, not lower than 220° C. but that the temperature at which the diamond carbonizes is not exceeded.

As means for heating the polishing member 3*a*, further, there can be employed such known heating means as various kinds of heaters, hot air, heating by flowing an electric current through a resistor, induction heating or high-energy beam depending upon the form of the polishing member 3*a*.

As described earlier, the above heating means can also be used as means for heating the diamond-surface instead of irradiating the laser beam.

The above polishing method of the present invention makes it possible to conduct the polishing without using a polishing member made of a particularly expensive compound but using a polishing member made of a simple metal, as well as to easily control the polishing. It is, therefore, allowed to effectively polish not only flat surfaces but also rugged three-dimensional surface and curved surface lending the polishing method well for polishing the workpieces having diamond surfaces of various shapes.

Further, though it pertains to a widely known method, it is also allowable to apply a laser absorber onto the diamond-surface prior to or during the polishing working to improve the energy absorbing efficiency of the diamond.

In order to enhance the reactivity of the polishing member with the diamond, further, the polishing may be conducted while blowing an oxygen gas or the like gas. To maintain the quality of polishing, further, the polishing may be conducted while effecting the evacuation or continuously or intermittently blowing the high-pressure air or a very small amount of washing solution to remove metal carbide or foreign matter produced by the polishing.

EXAMPLES

The invention will now be described by way of the following Experiments.

In the Experiments, the surface roughness was measured by a method described below.

Surface Roughness.

By using a surface roughness meter (Surfcom 575A) manufactured by Tokyo Seimitsusha Co., a maximum height Rz was measured in compliance with the JIS-B-0601.

<Experiment 1>

Use was made of a polish tester of a structure schematically shown in FIG. 1 and a test piece to be polished obtained by coating a substrate of a super hard alloy with the diamond by the hot-filament CVD method.

Test piece:

Shape: flat plate measuring 13 mm×13 mm (5 mm thick)

Substrate: cemented carbide

Thickness of diamond: 10 μm

Maximum height Rz: 1.5 μm (diamond-surface)

Laser (carbon dioxide gas laser), Evolution 100 W, manufactured by Synrad Co.:

Output: 100 W

Width of irradiation (spot diameter): ϕ0.2 mm

As a polishing member, a Ta wire having a circular shape in cross section and a diameter of 1 mm was attached to the above polish tester (see FIG. 3(*a*)), and a gap was set to be 2 mm between the position on where the laser is irradiated and the position where the polishing member comes in contact with the test piece. In this state, the polishing member (Ta wire) was pushed onto the surface of the test piece with a load of 10 N, and the test piece was polished by being moved at 72 m/min while being irradiated with the laser beam. After every end of the polishing, the test piece was moved by 0.005 mm perpendicularly to the direction of slide-rubbing. This operation was repeated a plurality of number of times (about 100 times) to execute a planar polishing test.

Figure 5:
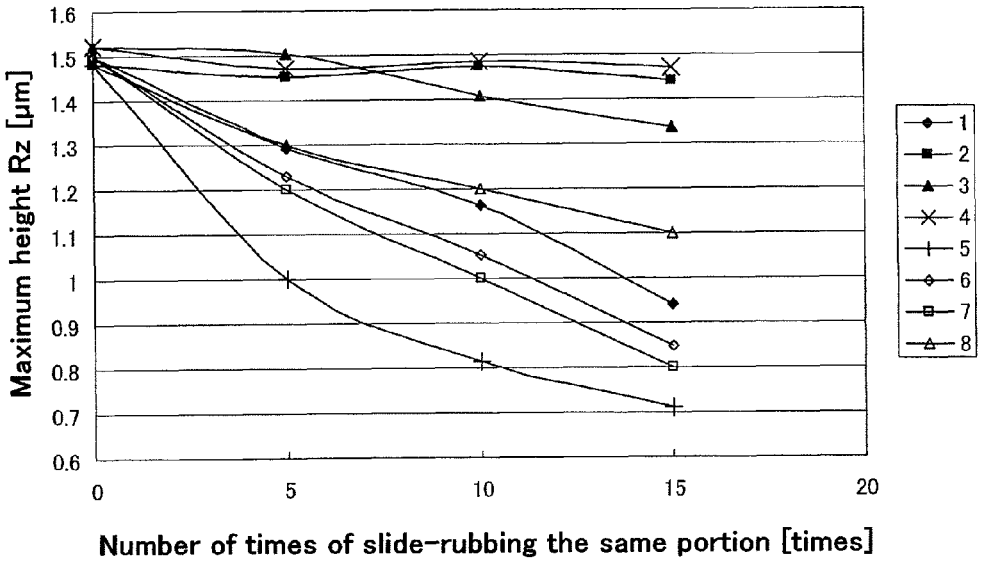
FIG. 5 is a diagram showing changes in the roughness of the diamond-surface in the polishing tests of the embodiment.

The contacting portion of the wire was changed every after 5 times of slide-rubbing of the same portion of the test piece. Further, a maximum height Rz of the polished portion was measured. The results were as shown in FIG. 5. The maximum height Rz decreased with an increase in the number of times of the slide-rubbing, from which it was confirmed that the polishing was conducted.

Table 1 shows the experimental conditions and the results of the following Experiments. Further, FIG. 5 shows relationships between the number of times of slide-rubbing and the maximum heights Rz like those of Experiment No. 1.

<Experiment 2>

The polishing test was conducted in quite the same manner as in Experiment 1 but without irradiated with the laser beam.

As a result, the diamond-surface was not quite polished.

<Experiment 3>

The polishing test was conducted in quite the same manner as in Experiment 1 but decreasing the intensity of the laser beam down to 50 W.

As a result, the polishing did not much proceed with 50 W as compared to Experiment 1 (100 W). When the intensity of the laser was decreased down to 25 W, the polishing was not almost conducted.

<Experiment 4>

The polishing test was conducted in quite the same manner as in Experiment 1 but without effecting the slide-rubbing with the polishing member.

As a result, it was confirmed that the diamond-surface was not quite polished.

<Experiment 5>

The polishing test was conducted in quite the same manner as in Experiment 1 but increasing the pushing force to 20 N.

As a result, it was confirmed that the polishing was conducted faster than in Experiment 1 (10 N).

<Experiments 6 to 8>

The polishing tests were conducted in quite the same manner as in Experiment 1 but changing the polishing member to Ti, Zr and Al. As a result, it was confirmed that the polishing proceeded faster when Ti and Zr were used than when Ta was used, but the polishing did not much proceed when Al was used.

Figure 6:
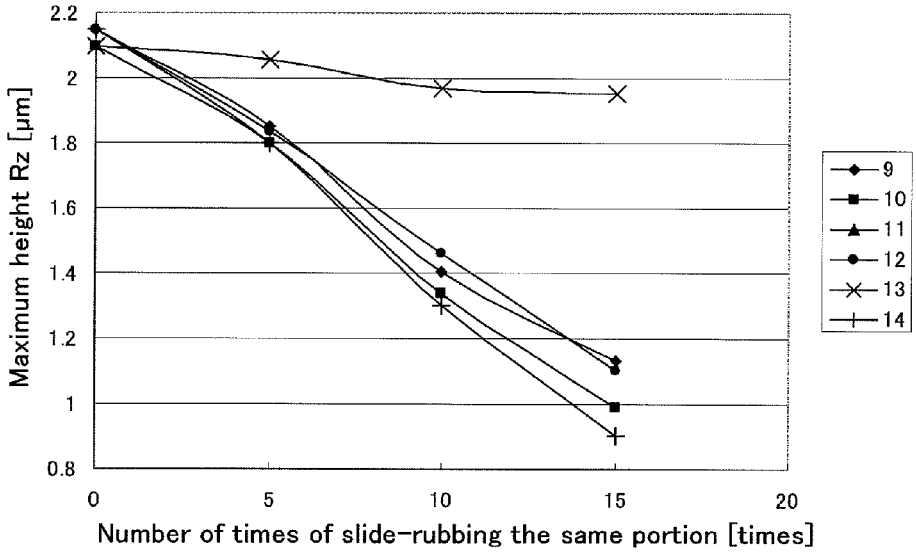
FIG. 6 is a diagram showing changes in the roughness of the diamond-surface in the polishing tests of the embodiment.

Table 2 shows the experimental conditions and the results of the following Experiments. FIG. 6 shows relationships between the number of times of slide-rubbing and the maximum heights Rz like those of Experiment No. 1.

<Experiment 9>

The polishing test was conducted in quite the same manner as in Experiment 1 but changing the movement of the test piece as described below, without irradiating the laser beam and heating the polishing member at 700° C. by using a heater.

Test piece moving speed: 18 m/min

Test piece slide-rub movement in the vertical direction: 0.025 mm/rev

It was confirmed that the maximum height Rz decreased with an increase in the number of times of slide-rubbing and the polishing was conducted.

<Experiment 10>

The polishing test was conducted in quite the same manner as in Experiment 9 but heating the polishing member at 800° C.

As a result, it was confirmed that the polishing proceeded faster than in Experiment 9 (700° C.).

<Experiment 11>

The polishing test was conducted in quite the same manner as in Experiment 9 but heating the polishing member at 500° C.

As a result, it was confirmed that the polishing proceeded slower than in Experiment 9 (700° C.).

<Experiment 12>

The polishing test was conducted in quite the same manner as in Experiment 9 but changing the polishing member to Fe.

As a result, it was confirmed that the polishing proceeded faster than in Experiment 9 (Ta).

<Experiment 13>

The polishing test was conducted in quite the same manner as in Experiment 12 but heating the polishing member at 500° C.

As a result, it was confirmed that the diamond-surface was not quite polished.

<Experiment 14>

The polishing test was conducted in quite the same manner as in Experiment 1 but changing the polishing member to Ni.

As a result, it was confirmed that the polishing proceeded faster than in Experiment 11 (Fe).

Figure 7:
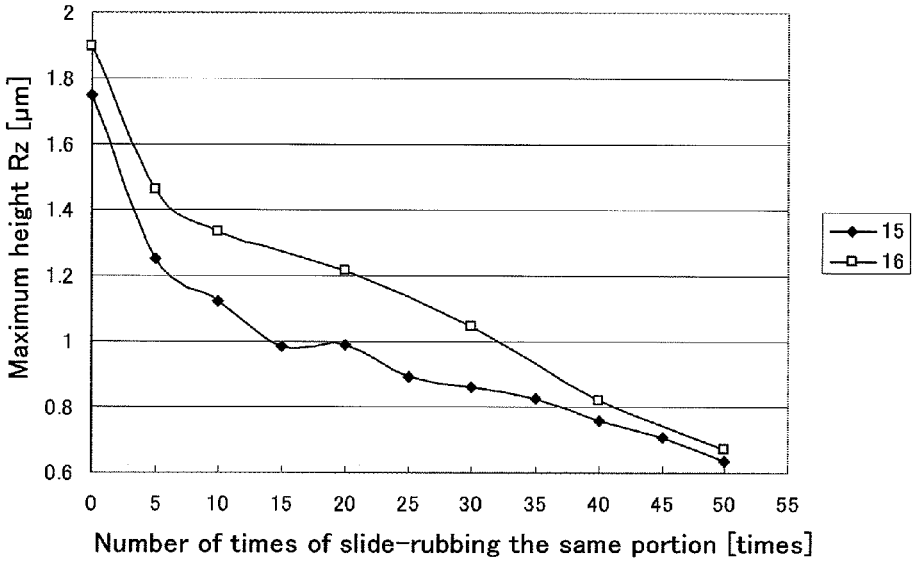
FIG. 7 is a diagram showing changes in the roughness of the diamond-surface in the polishing tests of the embodiment.
Figure 8:
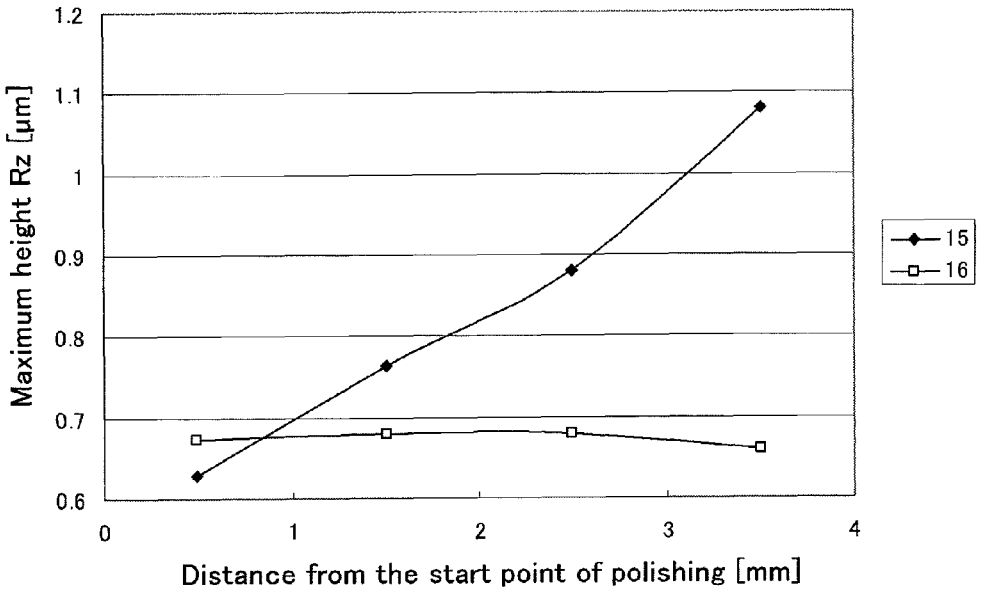
FIG. 8 is a diagram showing changes in the roughness of the diamond-surface in the polishing tests of the embodiment.

FIG. 7 shows relationships between the number of times of slide-rubbing and the maximum heights Rz like those of Experiment No. 1, and FIG. 8 shows relationships between the distances in the direction of outer diameter from the polishing start point and the maximum heights Rz after 50 times of slide-rubbing.

<Experiment 15>

The polishing test was conducted in quite the same manner as in Experiment 1 but changing the conditions as described below, moving the polishing member from the inner diameter toward the outer diameter at a rate of 0.025 mm/rev while rotating the test piece, ending the polishing when the end point is reached, changing the contacting portion of the wire and, thereafter, starting again the polishing from the inner diameter.

Test piece:

Shape: ring having an inner diameter of 33 mm and an outer diameter of 65 mm (12 mm thick)

Substrate: cemented carbide

Thickness of diamond: 20 μm

Maximum height Rz: 1.8 μm (diamond-surface)

Circumferential speed: 24 m/min

Load on polishing member: 20 N

Gap between the position on where the laser is irradiated and the position where the polishing member contacts to the test piece: 0.7 mm A maximum height Rz of the polished portion was measured on the same portion of the test piece every after 5 times of slide-rubbing.

As a result, it was confirmed that the maximum height Rz decreased with an increase in the number of times of slid-rubbing and the polishing was conducted. It was also confirmed that the polishing became slow as the polishing proceeded from the start point of polishing toward the end point.

<Experiment 16>

The polishing test was conducted in quite the same manner as in Experiment 13 but continuously feeding the Ta wire at 0.5 mm/s and changing the contacting portion.

As a result, it was confirmed that the amount of polishing was nearly constant irrespective of the position from the start point of polishing.

TABLE 1

| Experiment | Polishing member | Laser specifies | Laser intensity W | Irrad. Width mm | Irrad. Time s | Pushing force N | Testing rate m/min | Results |
|---|---|---|---|---|---|---|---|---|
| 1 | Ta | carbon dioxide | 100 | ϕ0.2 | 0.00018 | 10 | 72 | ○ |
| 2 | Ta | none | — | — | — | 10 | 72 | X |
| 3 | Ta | carbon dioxide | 50 | ϕ0.2 | 0.00018 | 10 | 72 | Δ |
| 4 | none | carbon dioxide | 100 | ϕ0.2 | 0.00018 | — | 72 | X |
| 5 | Ta | carbon dioxide | 100 | ϕ0.2 | 0.00018 | 20 | 72 | ○ |
| 6 | Ti | carbon dioxide | 100 | ϕ0.2 | 0.00018 | 10 | 72 | ○ |
| 7 | Zr | carbon dioxide | 100 | ϕ0.2 | 0.00018 | 10 | 72 | ○ |
| 8 | Al | carbon dioxide | 100 | ϕ0.2 | 0.00018 | 10 | 72 | Δ |

TABLE 2

| Experiment | Polishing member | Heating temp. W | Pushing force N | Testing rate m/min | Results of tests |
|---|---|---|---|---|---|
| 9 | Ta | 700 | 10 | 18 | ○ |
| 10 | Ta | 800 | 10 | 18 | ○ |
| 11 | Ta | 500 | 10 | 18 | ○ |
| 12 | Fe | 700 | 10 | 18 | ○ |
| 13 | Fe | 500 | 10 | 18 | X |
| 14 | Ni | 700 | 10 | 18 | ○ |

The results of the polishing tests after the slide-rubbings of 15 times were judged as follows when the amounts of polishing (−ΔRz) were:

less than 0.1 μm: ×

0.1 to less than 0.5 μm: Δ not less than 0.5 μm: ○

DESCRIPTION OF REFERENCE NUMERALS

1: workpiece of diamond

1*a*: diamond-surface

3*a*: polishing member

5: laser beam

The invention claimed is:

1. A method of polishing a diamond-surface by:

using a polishing member that has a linear, belt-like or rod-like shape and has a polishing surface that is one of:

a metal-surface that easily reacts with carbon; or a carburizing metal-surface;

polishing the diamond-surface with said polishing member by bringing into direct contact with one another the polishing surface and the diamond-surface and while continuously or intermittently varying the polishing surface of said polishing member; and heating said polishing member and/or said the diamond-surface prior to polishing with said polishing member, wherein the metal-surface that easily reacts with carbon is made of a simple metal selected from a group consisting of Zr, Ta, Ti, W, Nb or Al, and wherein the carburizing metal surface is made of a simple metal selected from a group consisting of Fe, Ni or Co.

2. The method of polishing a diamond-surface according to claim 1, wherein said polishing member utilizes the metal-surface that easily reacts with carbon.

3. The method of polishing a diamond-surface according to claim 1, wherein said polishing member utilizes the carburizing metal-surface.

4. The method of polishing a diamond-surface according to claim 3, wherein the heating comprises heating both the diamond-surface and the polishing member.

5. The method of polishing a diamond-surface according to claim 1, wherein the heating comprises heating the polishing member prior to polishing with said polishing member.

6. The method of polishing a diamond-surface according to claim 1, wherein during the polishing abraded powder generation is suppressed.

7. The method of polishing a diamond-surface according to claim 1, wherein the polishing results from robbing the diamond-surface of carbon.

8. The method of polishing a diamond-surface according to claim 1, wherein, during the polishing, a pressing force of about 5 N is utilized.

9. The method of polishing a diamond-surface according to claim 1, wherein the polishing utilises a surface pressure that is not changed by abrasion.

10. The method of polishing a diamond-surface according to claim 1, wherein the polishing occurs without abrading the diamond-surface.

11. A method of polishing a diamond-surface by:

using a polishing member that has a linear, belt-like or rod-like shape and has a metal-surface that easily reacts with carbon or has a carburizing metal-surface;

polishing the diamond-surface with said polishing member while continuously or intermittently varying a polishing surface of said polishing member; and heating said polishing member and/or said the diamond-surface prior to polishing with said polishing member, wherein the diamond-surface is heated by a irradiation with a laser beam prior to polishing with said polishing member, and following the irradiation with the laser beam, said polishing is conducted by rubbing a laser beam-irradiated portion with the polishing member.

12. A method of polishing a diamond-surface using a polishing member that has a linear, belt-like or rod-like shape and a polishing surface, the method comprising:

polishing the diamond-surface by bringing into contact the polishing member and the diamond-surface;

during the polishing, continuously or intermittently varying the polishing surface; and prior to the polishing, heating at least one of:

the polishing member; and/or the diamond-surface, wherein the polishing surface is one of:

a metal-surface that easily reacts with carbon and has a Vickers' hardness (Hv) not higher than 200; or a carburizing metal surface capable of causing carbon atoms to diffuse into the polishing member from the diamond-surface.

13. The method of polishing a diamond-surface according to claim 12, wherein the metal-surface that easily reacts with carbon is made of Zr, Ta, Ti, W, Nb or Al.

14. The method of polishing a diamond-surface according to claim 12, wherein the carburizing metal surface is made of Fe, Ni or Co.

15. The method of polishing a diamond-surface according to claim 12, wherein a material of the metal-surface that easily reacts with carbon is not made of a compound.

16. The method of polishing a diamond-surface according to claim 12, wherein a material of the carburizing metal surface is not made of a compound.

17. The method of polishing a diamond-surface according to claim 12, wherein the polishing occurs without abrading the diamond-surface.

18. The method of polishing a diamond-surface according to claim 12, wherein, during the polishing, a pressing force of about 5 N is utilised.

19. The method of polishing a diamond-surface according to claim 12, wherein the polishing utilises a surface pressure that is not changed by abrasion.

20. The method of polishing a diamond-surface according to claim 12, wherein, during the polishing, the polishing surface is a new continuously changing polishing surface.

* * * * *